US007628655B1

(12) United States Patent
Chen

(10) Patent No.: US 7,628,655 B1
(45) Date of Patent: Dec. 8, 2009

(54) ELECTRICAL CONNECTOR AND INSERTING METHOD THEREOF

(75) Inventor: Yu Sheng Chen, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/222,393

(22) Filed: Aug. 8, 2008

(30) Foreign Application Priority Data

Jun. 11, 2008 (CN) ..... 2008 1 0124912

(51) Int. Cl.
*H01R 24/00* (2006.01)

(52) U.S. Cl. ..... 439/660; 439/60

(58) Field of Classification Search ..... 439/660, 439/60, 79, 80, 630, 637, 607.31, 607.32, 439/607.33, 607.4
See application file for complete search history.

(56) References Cited

U.S. PATENT DOCUMENTS 6,334,781 B1 * 1/2002 Nishio et al. ..... 439/76.1
6,508,678 B1 * 1/2003 Yang ..... 439/677
6,902,432 B2 * 6/2005 Morikawa et al. ..... 439/607.41
7,427,214 B2 * 9/2008 Liao et al. ..... 439/607.01
7,467,977 B1 * 12/2008 Yi et al. ..... 439/607.01
7,517,253 B1 * 4/2009 Chiang ..... 439/660
7,540,786 B1 * 6/2009 Koser et al. ..... 439/660
2007/0173129 A1 * 7/2007 Han ..... 439/660
2008/0218799 A1 * 9/2008 Hiew et al. ..... 358/1.16

* cited by examiner

*Primary Examiner*—Neil Abrams
*Assistant Examiner*—Harshad C Patel
(74) *Attorney, Agent, or Firm*—Rosenberg, Klein & Lee

(57) ABSTRACT

An electrical connector includes an insulating body with a main body portion in which a first receiving space is concavely formed. Spaced first terminal passages extend in a top surface of the first receiving space. A second receiving space is formed in the front end of the main body portion and connected with the first receiving space. A tongue plate extends forwards from a front end face of the main body portion and has a working surface in which spaced second terminal passages extend. The second receiving space is located above the tongue plate. First and second conductive terminals are respectively correspondingly received in the first and the second terminal passages. When a memory card is inserted into the connector, there is no other in-series disturbed signal noise for stable signal transmission; and when the memory card is inserted to its position, it cannot swing and can be connected stably.

26 Claims, 12 Drawing Sheets

ELECTRICAL CONNECTOR AND INSERTING METHOD THEREOF

BACKGROUND OF THE INVENTION

1. Field of the Invention

The present invention relates to an electrical connector, and more especially to an electrical connector which can be not only connected with a socket assembly (for example, a standard USB socket connector), but also securely connected with a plug assembly (for example, a memory card), and method of inserting the electrical connector.

2. Description of Related Art

Universal Serial Bus (USB) is an electrical connector which can transmit high-speed signals. At present, USB is widely used to connect all kinds of electronic hosts and external devices. With the popularity of USB connectors, various electrical connectors are designed to have expansion functions and simultaneously transmit standard USB interface electrical signals and other additional electrical signals (for example, memory card electrical signals) based on original USB standard.

A standard USB connector 100 (please refer to FIG. 1 and FIG. 2) generally includes an insulating body 110. The insulating body 110 has a base portion 111 which extends forwards to form a tongue plate 112. A plurality of terminal passages 113 extend through the base portion 111 along a butting direction to a surface of the tongue plate 112. A plurality of conductive terminals 120 is respectively correspondingly disposed in the terminal passages 113. Each conductive terminal 120 has a contacting portion 123, a tail portion 122 and a fixing portion 121 connecting the contacting portion 123 with the tail portion 122.

A conventional memory card 4 (please refer to FIG. 3), such as Micard, generally has an inserting end (front end) 41 and an opposite end (rear end) 42, a first insulating surface (front face) 43 and a second insulating surface (back face) 44. The first insulating surface 43 has a first interface 45 near the inserting end 41, and the first interface 45 may be a USB interface and have a plurality of first contacting points 450 arranged in rows. Furthermore, the first insulating surface 43 may also have a second interface 46 adjacent to the first interface 45, and the second interface 46 has a plurality of second contacting points 460 arranged in rows. The first insulating surface 43 may further have a third interface 47 near the opposite end 42, and the third interface 47 has a plurality of third contacting points 470 arranged in rows. Of course, the first insulating surface 43 may also have other types of interfaces formed thereon. Generally, there is no interface on the second insulating surface 44. The second insulating surface 44 has two concave portions 440 respectively concavely formed two side edges thereof. One step surface is formed between each concave portion 440 and the insulating surface 44.

Before memory card electrical connectors (please refer to FIG. 2) come out, the memory card 4 is directly inserted into the conventional USB connector 100 so that each first contacting points 450 of the first interface 45 of the memory card 4 is electrically connected with the contacting portion 123 of each conductive terminal 120 to form an electrical connection. However, because the memory card 4 is too long and the protruding portion of the memory card 4 which extends out of the connector 100 is too long, so the memory card 4 is easy to swing and touch other objects so that the memory card 4 and the USB connector 100 are damaged.

For solving the problem described above, an improved electrical connector 200 (please refer to FIG. 4) comes out.

Basing on the conventional USB connector 100, the length of the base portion 111 of the electrical connector 200 is increased and a slot 114 is concavely formed in the surface of the base portion 111 which extends to form the tongue plate 112. The bottom of the slot 114 and the side of the tongue plate 112 on which the terminal passages 113 are extended generally lie in the same plane. Each conductive terminal 120 has a front contacting portion 123 and a rear contacting portion 124 respectively received in the portion of a corresponding terminal passage 113 located on the tongue plate 112 and the portion of the corresponding terminal passage located on the bottom of the slot 114. The improved electrical connector 200 can contact with the contacting points of the memory card 4 to form the electrical connection when the memory card 4 is inserted into the electrical connector 200 deeply. At this time, the protruding portion of the memory card 4 which extends out of the electrical connector 200 is very short, so the swing of the memory card 4 can be avoided, and even if there is a little swing, the memory card 4 isn't easy to touch other objects. However, when the memory card 4 is inserted into the electrical connector 200, each first contacting point 450 of the first interface 45 firstly correspondingly contacts with the front contacting portion 123 of each conductive terminal 120. Till the memory card 4 is inserted to its position, each first contacting point 450 of the first interface 45 securely contacts with the rear contacting portion 124 of each conductive terminal 120. So there firstly occurs short conduction, then short non-conduction, and finally stable electrical connection between the memory card 4 and the electrical connector during the inserting of the memory card 4, which is easy to cause that the system and the memory card are damaged. Furthermore, there may be more than one interface on the surface of the memory card 4, so after the memory card 4 is inserted to its position, the front contacting portion 123 of the conductive terminal 120 may contact with contacting points of other interfaces on the surface of the memory card 4 (such as the second contacting point 460 of the second interface 46). However, because the interfaces of the memory card 4 operate at different voltages and transmit different signals after being electrically connected, the contact of the front contacting portion 123 of the conductive terminal 120 and contacting points of other interfaces on the surface of the memory card 4 will cause that non-specific conduction occurs and signals are transmitted in disorder, thereby damaging the system and the memory card.

Hence, there is a need for a new electrical connection and inserting method thereof to solve the problems described above.

SUMMARY OF THE INVENTION

An object of the present invention is to provide an electrical connector and inserting method thereof, wherein the electrical connector can be not only connected with a socket assembly (for example, a standard USB socket connector), but also securely connected with a plug assembly (for example, a memory card), and the electrical connector can stably transmit signals when being connected with the plug assembly.

To achieve the above-mentioned object, an electrical connector in accordance with the present invention is provided. The electrical connector includes an insulating body having a main body portion, wherein a first receiving space is concavely formed in the main body portion and extends from a front end of the main body to a rear end of the main body and the main body portion has a plurality of spaced first terminal passages extending in a top surface of the first receiving space; a second receiving space is formed in the front end of the main body portion and connected with the first receiving space; and a tongue plate extends forwards from a front end face of the main body portion, the second receiving space is located above the tongue plate, and the tongue plate has a working surface in which a plurality of spaced second terminal passages extends; a plurality of first conductive terminals which is respectively correspondingly received in the first terminal passages; and a plurality of second conductive terminals which is respectively correspondingly received in the second terminal passages.

Comparing with conventional electrical connectors, the electrical connector of the present invention has the plurality of spaced first terminal passages extending in the top surface of the first receiving space. The tongue plate has a working surface and the plurality of spaced second terminal passages extends in the working surface. So the first terminal passages and the second terminal passages are not in a same plane and are arranged back and forth along the inserting direction. Also, since the plurality of first conductive terminals is respectively correspondingly received in the first terminal passages and the plurality of second conductive terminals is respectively correspondingly received in the second terminal passages, the first conductive terminals and the second conductive terminals are not in a same plane and are arranged back and forth along the inserting direction. When a socket assembly (for example, a standard USB socket connector) is inserted into the electrical connector, the socket assembly can be electrical connected with the second conductive terminals; and when a plug assembly (for example, memory card, Micard) is inserted into the electrical connector, the surface of the memory card with contacting points is electrically connected with the first conductive terminals in the first receiving space and the surface of the memory card without contacting points attaches to the bottom surface of the first receiving space, so that the memory card is only electrically connected with the first conductive terminals, so there is no other in-series disturbed signal noise for stable signal transmission. Furthermore, the memory card enters the second receiving space 53 and the first receiving space 52 in turn when being inserted, so the protruding portion of the memory card which extends out of the electrical connector when the memory card is inserted in its position is short, thereby the memory card cannot swing and can be connected stably.

The present invention further provides an electrical connector which includes a socket connector having a main body portion, wherein an inserting space is concavely formed in the main body portion and extends from a front end of the main body to a rear end of the main body, and the main body portion has a plurality of spaced first conductive terminals extending on a top surface of the inserting space; and a plug connector extending from the socket connector, wherein the plug connector has a tongue plate extending forwards from a front end of a bottom of the main body portion of the socket connector, and a plurality of spaced second conductive terminals extends on a surface of the tongue plate; whereby when an plug assembly is connected, the plug assembly goes over the tongue plate of the plug connector and is just inserted in the inserting space of the socket connector; and when a socket assembly is connected, the socket assembly just covers the tongue plate of the plug connector and is blocked outside the socket connector.

Comparing with conventional electrical connectors, the electrical connector of the present invention includes the socket connector having the main body portion. The inserting space is concavely formed in the main body portion and extends from a front end of the main body to a rear end of the main body, and the main body portion has the plurality of spaced first conductive terminals extending on the top surface of the inserting space. When an plug assembly (for example, memory card, Micard) is connected, the plug assembly goes over the tongue plate of the plug connector and is just inserted in the inserting space of the socket connected, so that the plug assembly is only electrically connected with the first conductive terminals inserted in the inserting space. So the plug assembly is only electrically connected with the first conductive terminals, thereby there is no other in-series disturbed signal noise for stable signal transmission. Also, when the plug assembly is inserted into the electrical connector, the plug assembly goes over the tongue plate of the plug connector and is just inserted in the inserting space of the socket connector, so the plug assembly is positioned in the inserting space and above the tongue plate, thereby the protruding portion of the plug assembly which extends out of the electrical connector when the plug assembly is inserted in its position is short, thereby the plug assembly cannot swing and can be connected stably.

The present invention further provides an electrical connector which includes a main body portion which has a receiving space concavely formed in a front end thereof, a protrusion extending forwards from the front end thereof and a cutout concavely formed in a bottom thereof, wherein the protrusion has a guiding surface formed on a top thereof and connected with a bottom surface of the receiving space, and the cutout is connected with the receiving space; a plurality of spaced first conductive terminals disposed on a top surface of the receiving space and each having a first connecting portion which is formed by extending each first conductive terminal rearwards through a rear end of the main body portion and then bending the first conductive terminal downward; and a plurality of spaced second conductive terminals disposed on the guiding surface of the protrusion and each having a second connecting portion which is formed by bending and extending the second conductive terminal downward when the second conductive terminal is extended to the cutout.

Comparing with conventional electrical connectors, the electrical connector of the present invention includes the main body portion which has the receiving space concavely formed in the front end thereof and the plurality of spaced first conductive terminals disposed on the top surface of the receiving space. When a plug assembly (for example, memory card, Micard) is inserted into the electrical connector, the surface of the memory card with contacting points is electrically connected with the first conductive terminals located in the receiving space and the surface of the memory card without contacting points attaches to the bottom surface of the receiving space, so that the memory card is only electrically connected with the first conductive terminals, so there is no other in-series disturbed signal noise for stable signal transmission. Furthermore, the main body portion has the protrusion extending forwards from the front end thereof, and the protrusion has the guiding surface formed on a top thereof and connected with the bottom surface of the receiving space, so the memory card enters the receiving space from the guiding surface when being inserted, that is, the memory card can be received in the longer inserting space which is formed by the space above the guiding surface and the receiving space, so the protruding portion of the memory card, which extends out of the electrical connector when the memory card is inserted in its position, is short, thereby the memory card cannot swing and can be connected stably. Additionally, the plurality of spaced second conductive terminals is disposed on the guiding surface of the protrusion, and when each second conductive terminal is extended to the cutout, the second conductive terminal is bent and extends downward to form the second connecting portion. The second conductive terminal doesn't like each first conductive terminal which is bent and extends downward after extending rearwards through the rear end of the main body portion. So the whole length of each second conductive terminal is reduced, so that manufacturing materials are saved, production cost is reduced, and signal transmission distance effectively decreases and the resistance is reduced, which is favorable to high-frequency transmission.

The present invention further provides a method of inserting an electrical connector, and the method includes the steps of: (1). providing an electrical connector which includes: a main body portion having a receiving space which is concavely formed in the main body portion and extends from a front end face of the main body to a rear end face of the main body, and a tongue plate extending forwards from a front end of a bottom of the main body portion; a plurality of spaced first conductive terminals disposed on a top surface of the receiving space; and a plurality of spaced second conductive terminals disposed on an upper surface of the tongue plate; (2). providing a memory card which has a first insulating surface and a second insulating surface opposite to the first insulating surface, wherein the first insulating surface has a plurality of spaced contacting points; (3). disposing the memory card in front of the electrical connector correspondingly, the first insulating surface facing up and the opposite second insulating surface facing down; and (4). pushing the memory card so that the memory card goes over the tongue plate of the electrical connector and enters the receiving space, each of the contacting points of the first insulating surface is just correspondingly electrically connected with one of the first conductive terminals, and the second insulating surface contacts with the second conductive terminals.

Comparing with conventional methods, the method of the present invention includes: pushing the memory card so that the memory card goes over the tongue plate of the electrical connector and enters the receiving space, each of the contacting points of the first insulating surface is just correspondingly electrically connected with one of the first conductive terminals, and the second insulating surface contacts with the second conductive terminals. So the memory card is only electrically connected with the first conductive terminals, thereby there is no other in-series disturbed signal noise for stable signal transmission. Also, when the memory card is inserted into the electrical connector, the memory card goes over the tongue plate of the electrical connector and enters the receiving space, so the memory card is received in the inserting space which is formed by the space above the tongue plate and the receiving space, so the protruding portion of the memory card, which extends out of the electrical connector when the memory card is inserted in its position, is short, thereby the memory card cannot swing and can be connected stably.

DETAILED DESCRIPTION OF THE PREFERRED EMBODIMENTS

To further understand features and technical contents of the present invention, please refer to the drawings and the following detailed description related the electrical connector according to the present invention.

Figure 5:
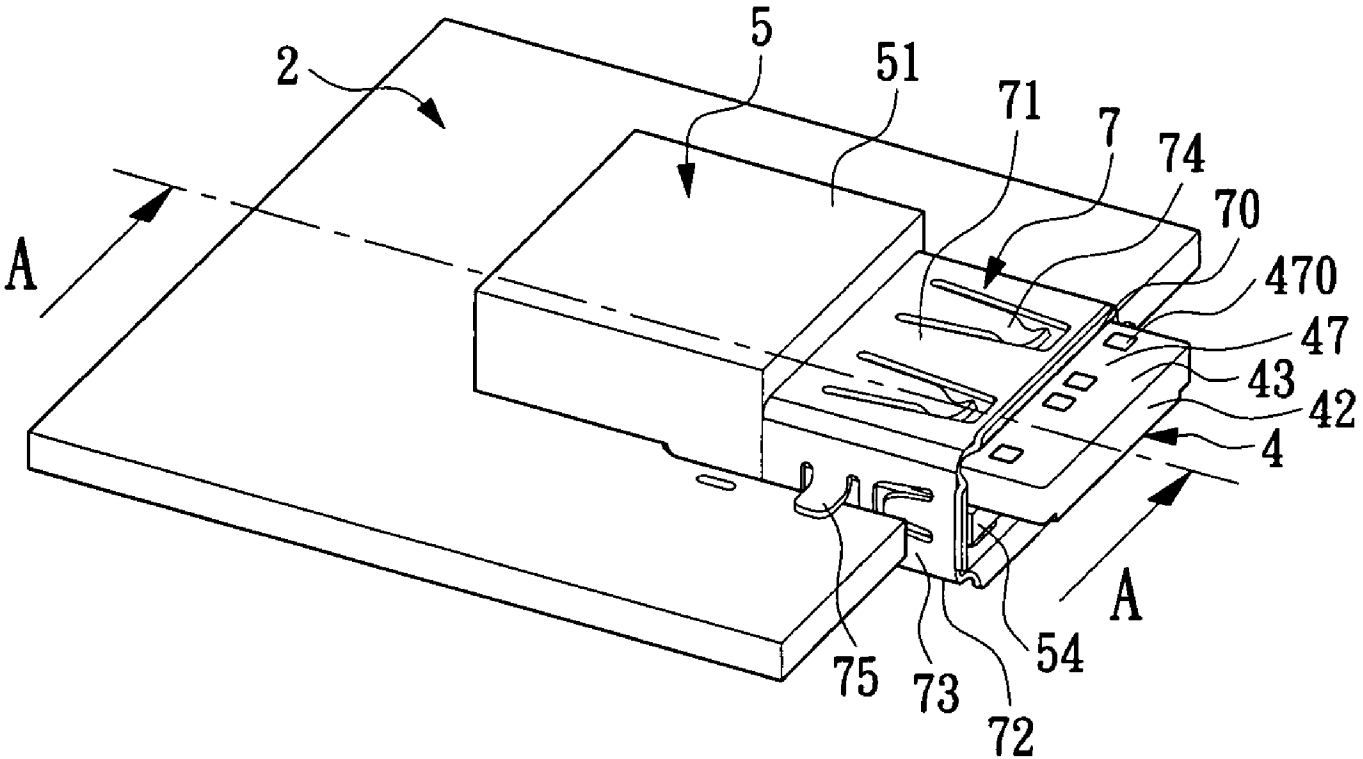
FIG. 5 is an assembled perspective view of an electrical connector according to the present invention connected with a plug assembly.
Figure 7:
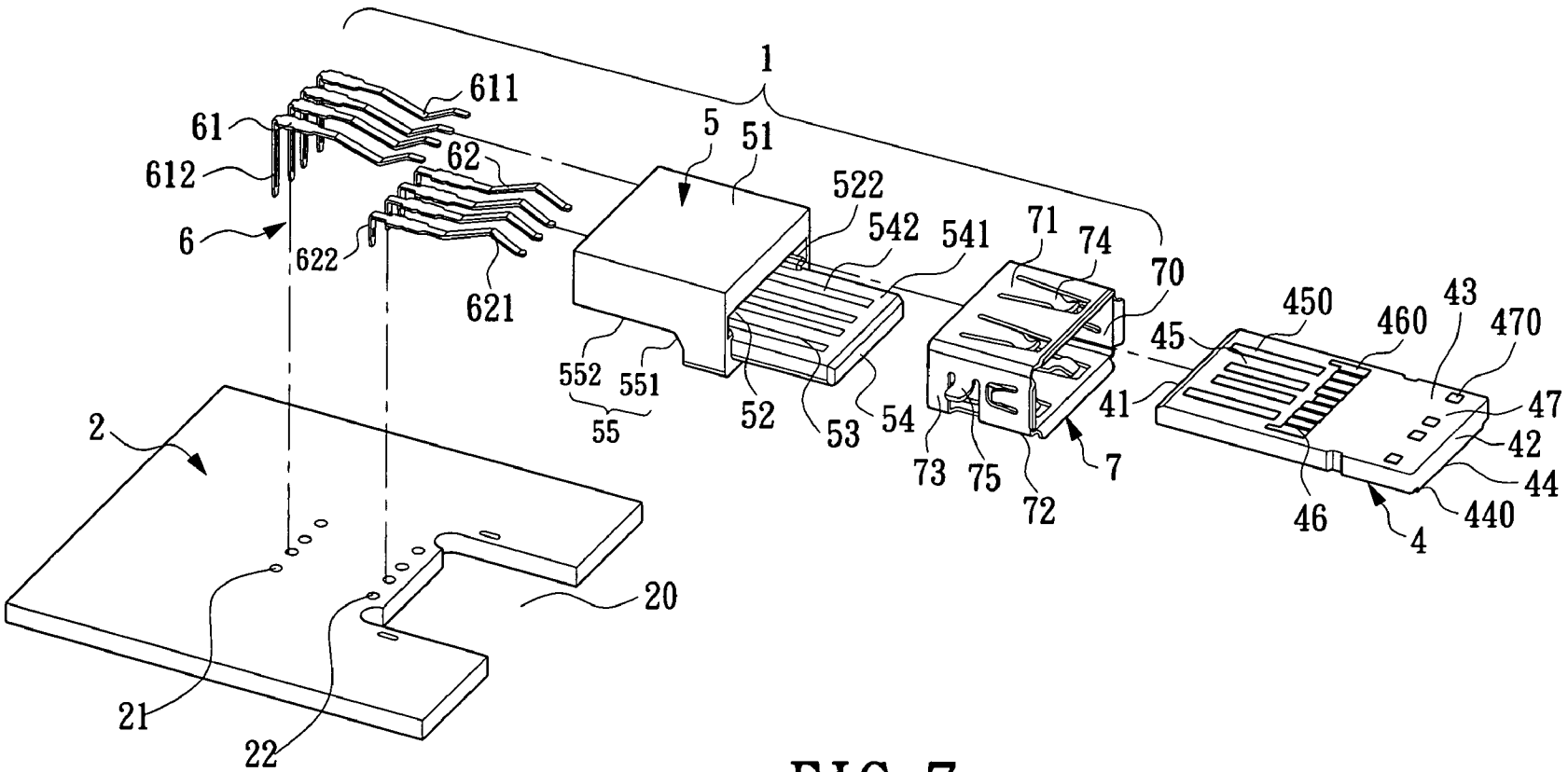
FIG. 7 is an exploded perspective view of the electrical connector and the plug assembly in FIG. 5.
Figure 8:
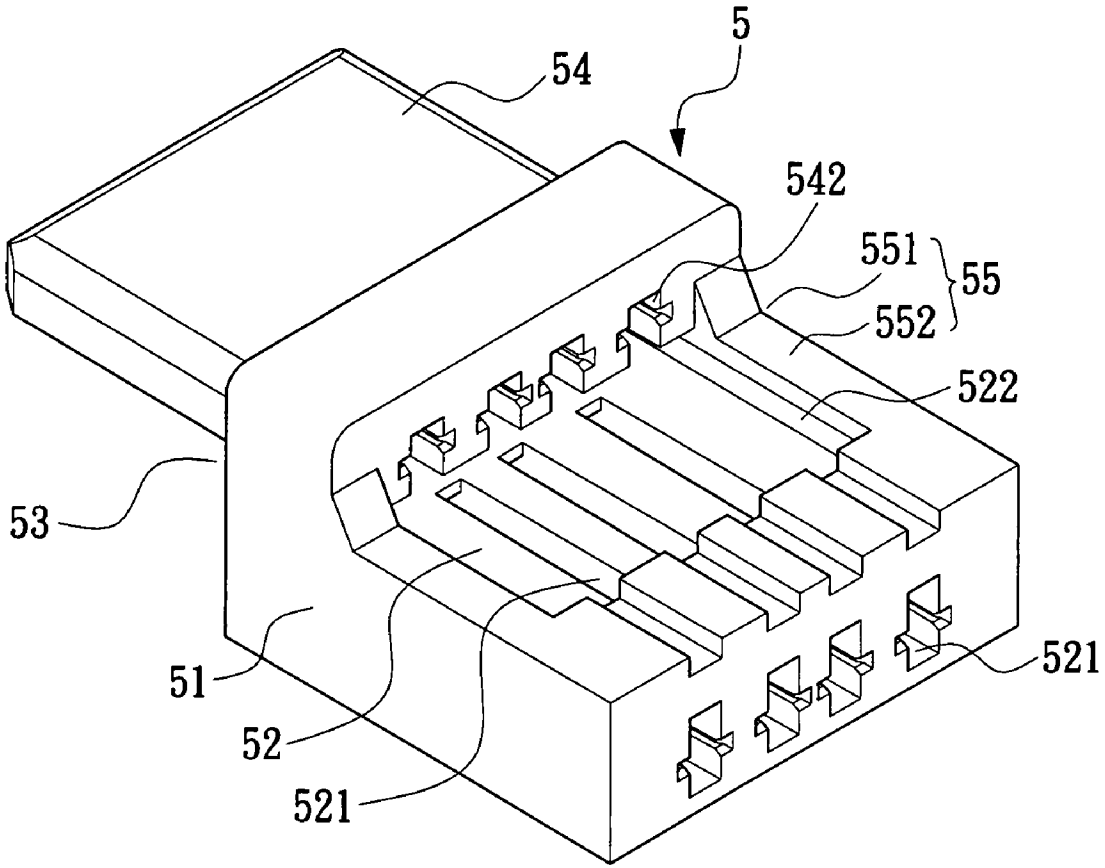
FIG. 8 is a perspective view of an insulating body of the electrical connector in FIG. 5, from another angle.
Figure 12:
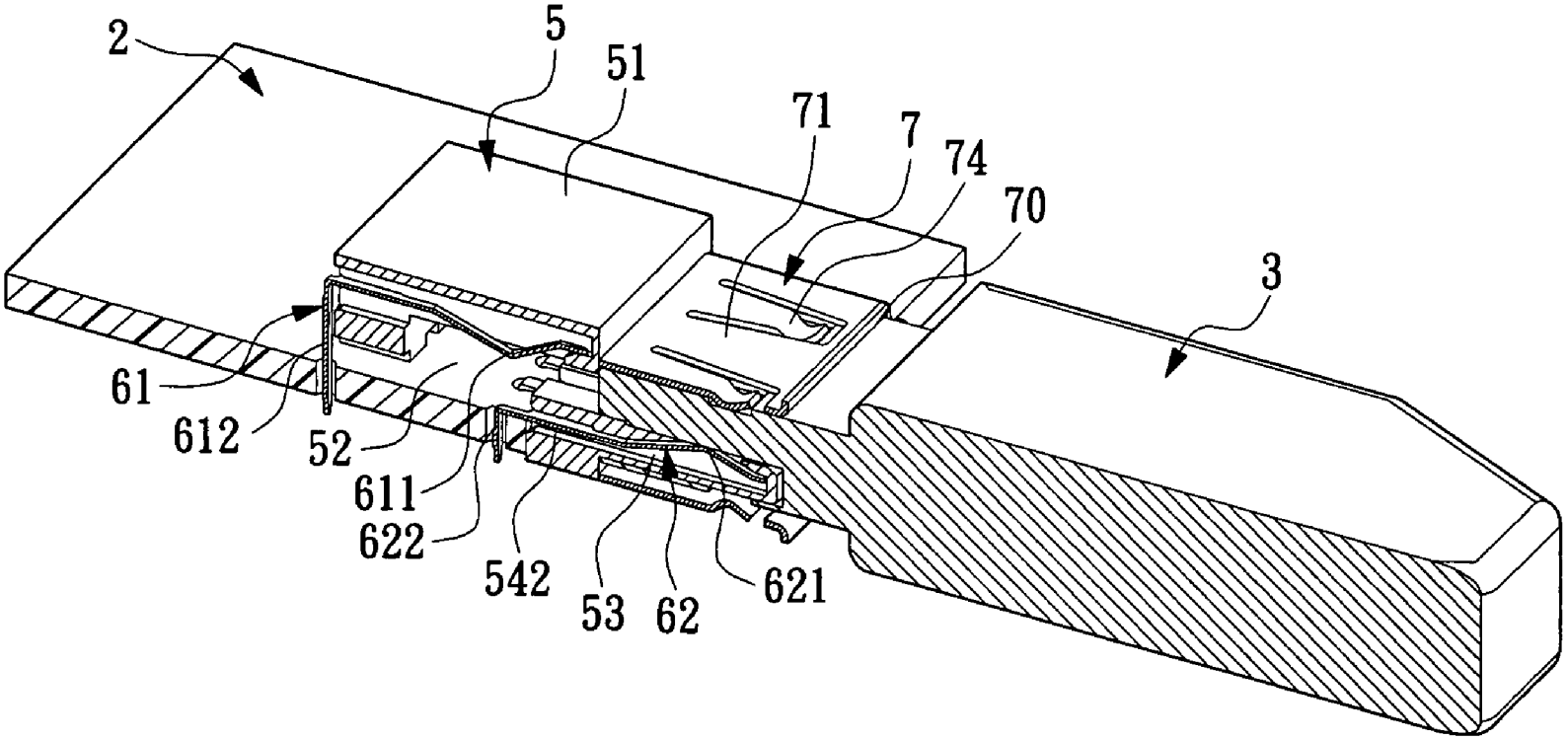
FIG. 12 is a cross-sectional view of the electrical connector according to the present invention connected with a socket assembly.

Please refer to FIG. 5, FIG. 7 and FIG. 12, an electrical connector 1 of the present invention may be mounted on a circuit board 2 for being connected with a socket assembly (for example, a standard USB socket connector) 3 or a plug assembly (for example, memory card, Micard) 4. The electrical connector 1 includes an insulating body 5, a plurality of conductive terminals 6 and a shielding casing 7.

Figure 9:
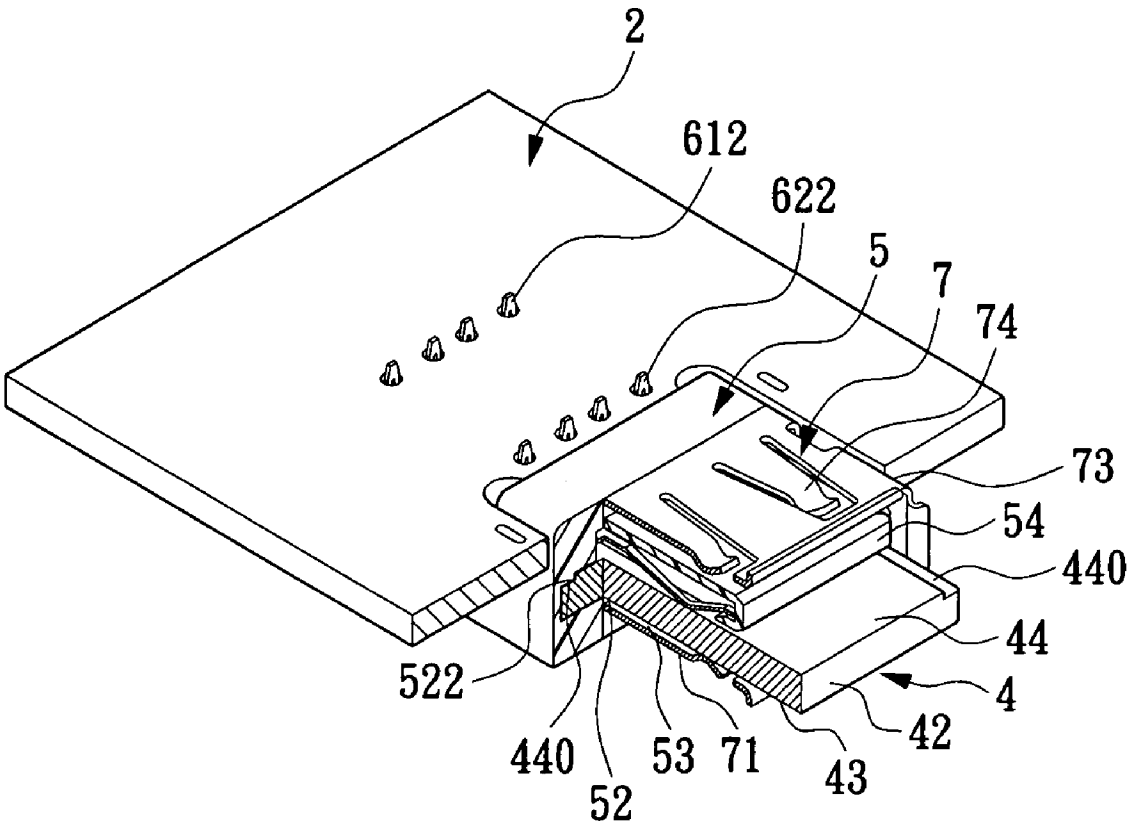
FIG. 9 is a partially cross-sectional view of the electrical connector and the plug assembly in FIG. 5, from another angle.

Please refer to FIGS. 5-8, the insulating body 5 includes a main body portion 51. A first receiving space (inserting space) 52 is concavely formed in the main body portion 51 and extends from a front end face of the main body to a rear end face of the main body. A plurality of spaced first terminal passages 521 extends between a top of the main body portion 51 and a top surface of the first receiving space 52. At least one side of the first receiving space 52 has a fool-proof unit 522 formed thereon. In the embodiment, the fool-proof units 522 are protruding blocks 522 respectively disposed on two sides of the first receiving space 52 near a bottom surface of the first receiving space 52. One step surface is formed between each protruding block 522 and the bottom surface of the first receiving space 52. The second insulating surface 44 of the memory card 4 has two concave portions 440 respectively concavely formed in two side edges thereof. The protruding blocks 522 and the concave portions 440 engage with each other to prevent the memory card 4 from being inserted by mistake. That is, when the memory card 4 is inserted correctly, the protruding blocks 522 are just locked in the concave portions 440 of the memory card 4 and perform a guiding function; and when the memory card 4 is inserted by mistake, the protruding blocks 522 block the memory card 4 and prevent the memory card 4 from entering the first receiving space 52 (simultaneously refer to FIG. 9). A tongue plate (protrusion) 54 extends forwards from the front end face of the main body portion 51. The main body portion 51 of the insulating body 5 also has a second receiving space (containing space) 53 in the front end thereof. The second receiving space 53 is located above the tongue plate 54 and connected with the first receiving space 52. The tongue plate 54 has a working surface 541, and in the embodiment, the working surface 541 is adjacent to the second receiving space 53 on the tongue plate 54, that is, the working surface 541 is the top surface of the tongue plate 54. At this time, the working surface 541 also forms a guiding surface 541 which guides the memory card 4 to enter the first receiving space 52 when the memory card 4 can be just inserted into the electrical connector 1. Of course, the present invention also can take a surface of the tongue plate 54 far away from the second receiving space 53 as the working surface depending on the situation. A plurality of spaced second terminal passages 542 extends in the working surface 541, and each first terminal passage 541 is disposed corresponding to each second terminal passage 542. The main body portion 51 has a cutout 551 concavely formed in the bottom thereof, which is connected with the first receiving space 52, and a mounting surface 552 formed adjacent to the cutout 551. The cutout 551 and the mounting surface 552 form a mounting portion 55.

Figure 6:
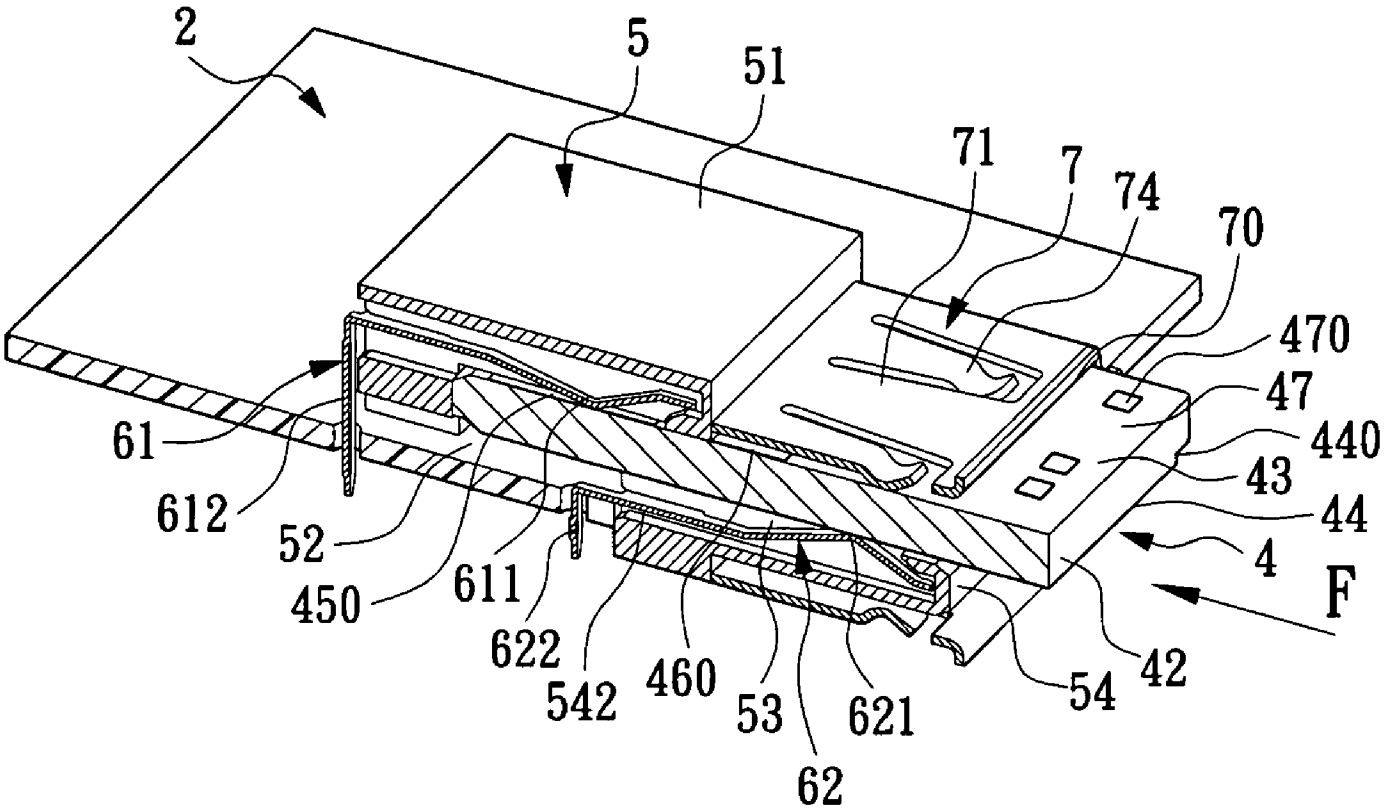
FIG. 6 is a cross-sectional view taken along lines A-A in FIG. 5.

Please refer to FIG. 6 and FIG. 7, the shielding casing 7 abuts against the front end of the main body portion 51 and surrounds the tongue plate 54 and the second receiving space 53, thereby forming a butting portion (inserting opening) 70 for being inserted an external assembly into. The butting portion 70 includes a butting space which is defined by the shielding casing 7 and the tongue plate 54 together and contains the second receiving space 53. The shielding casing 7 includes a top plate 71, a bottom plate 72 and two side plates 73. The second receiving space 53 is defined by the top plate 71 and the working surface 541 of the tongue plate 54. The shielding casing 7 has a plurality of elastic pieces 74 extending into the inserting opening 70 and welding pieces 75 bent to extend outwards from the two side plates 73. The welding pieces 75 may be welded on corresponding welding points (not shown) on the circuit board 2, thereby fixing the shielding casing 7 on the circuit board 2.

Figure 1:
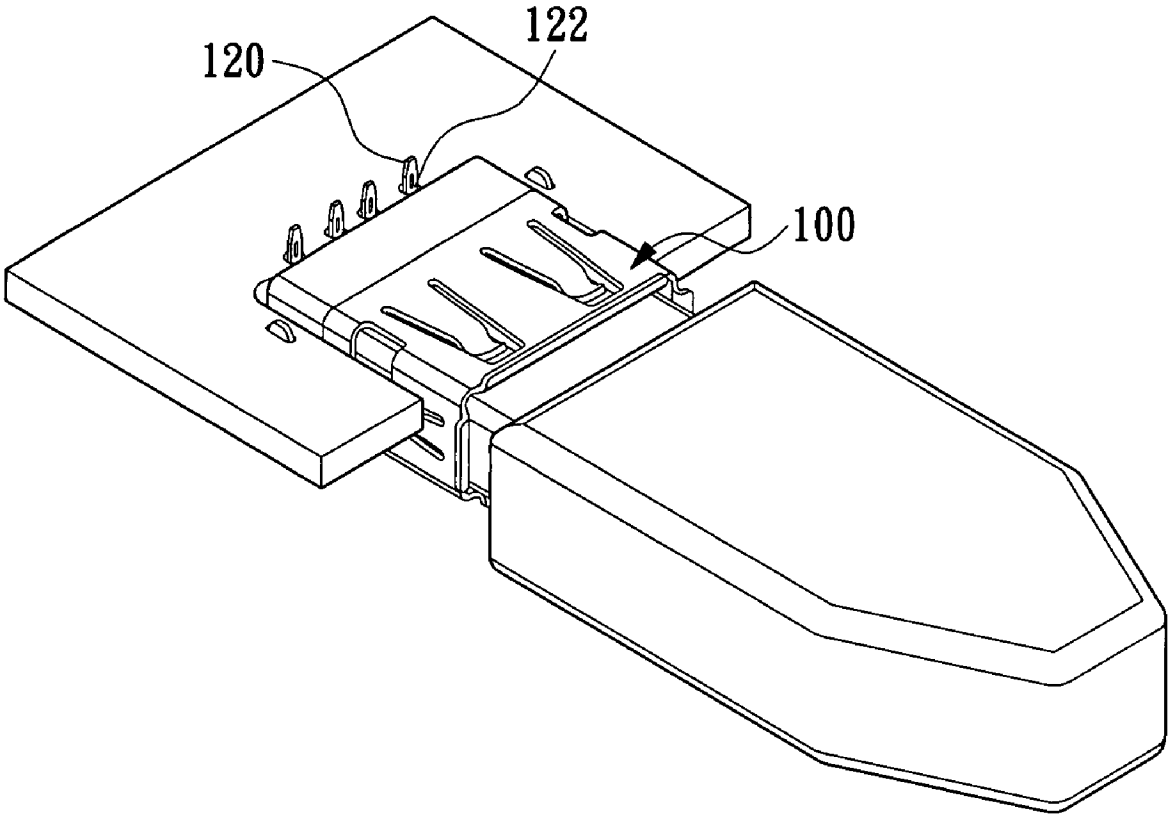
FIG. 1 is an assembled perspective view of a conventional electrical connector connected with a socket assembly.
Figure 2:
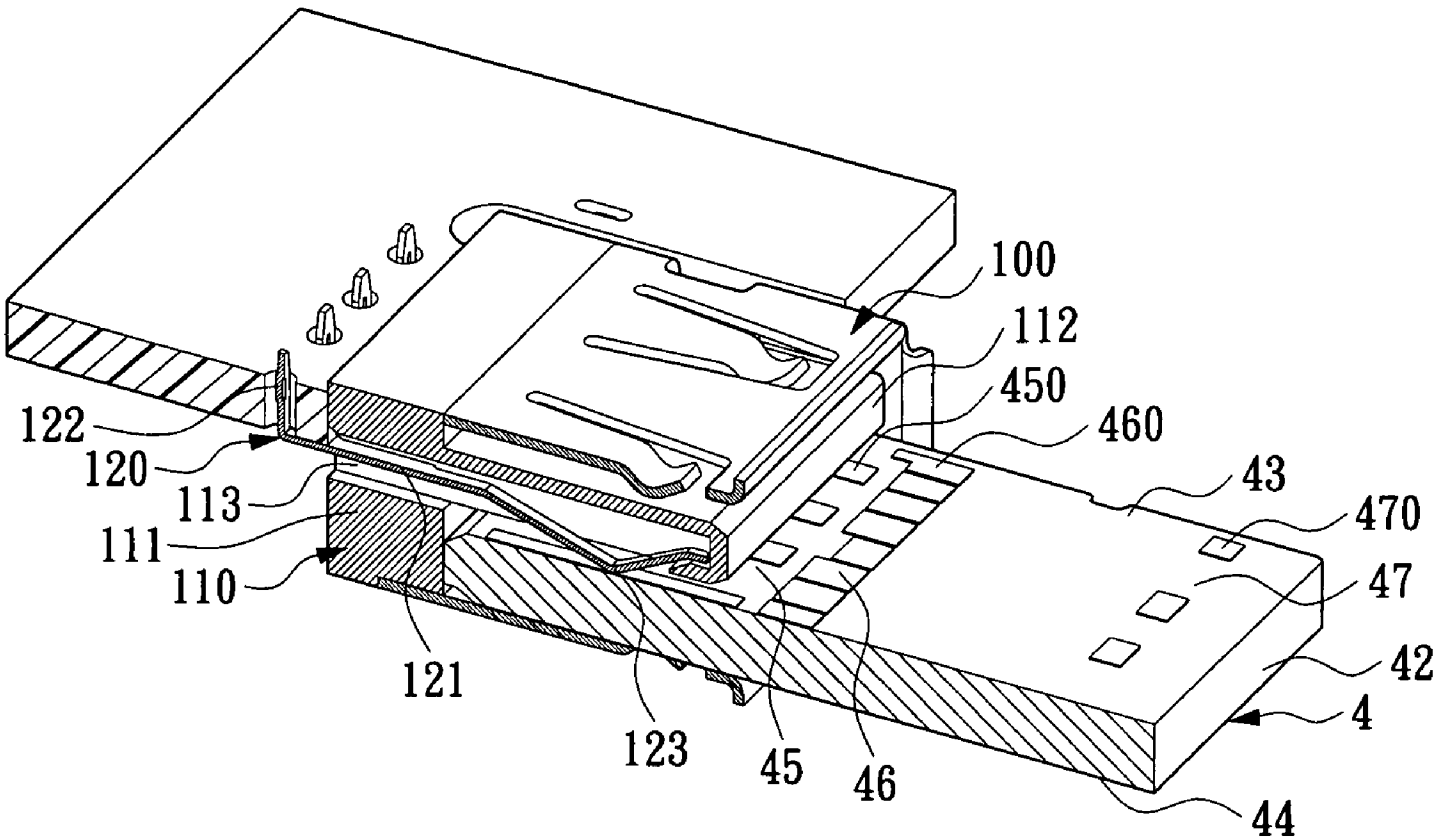
FIG. 2 is an assembled perspective view of the conventional electrical connector connected with a plug assembly.
Figure 3:
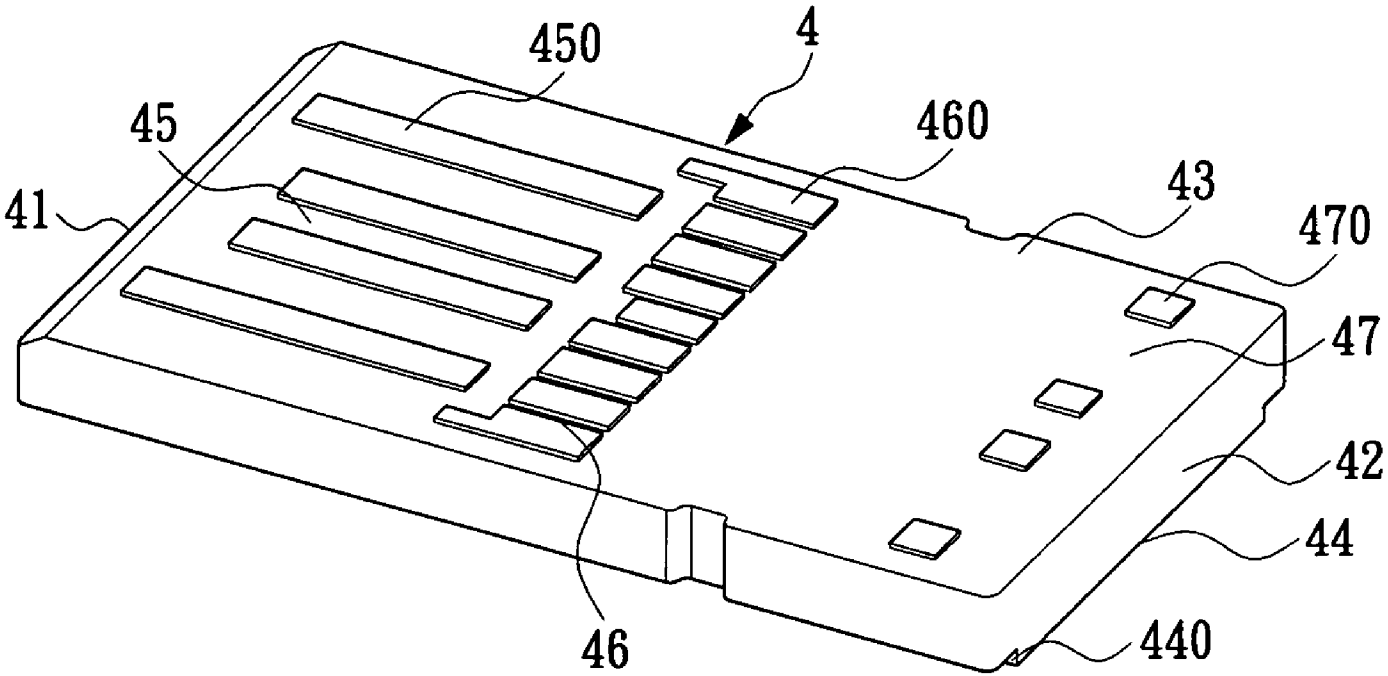
FIG. 3 is a perspective view of a plug assembly.
Figure 4:
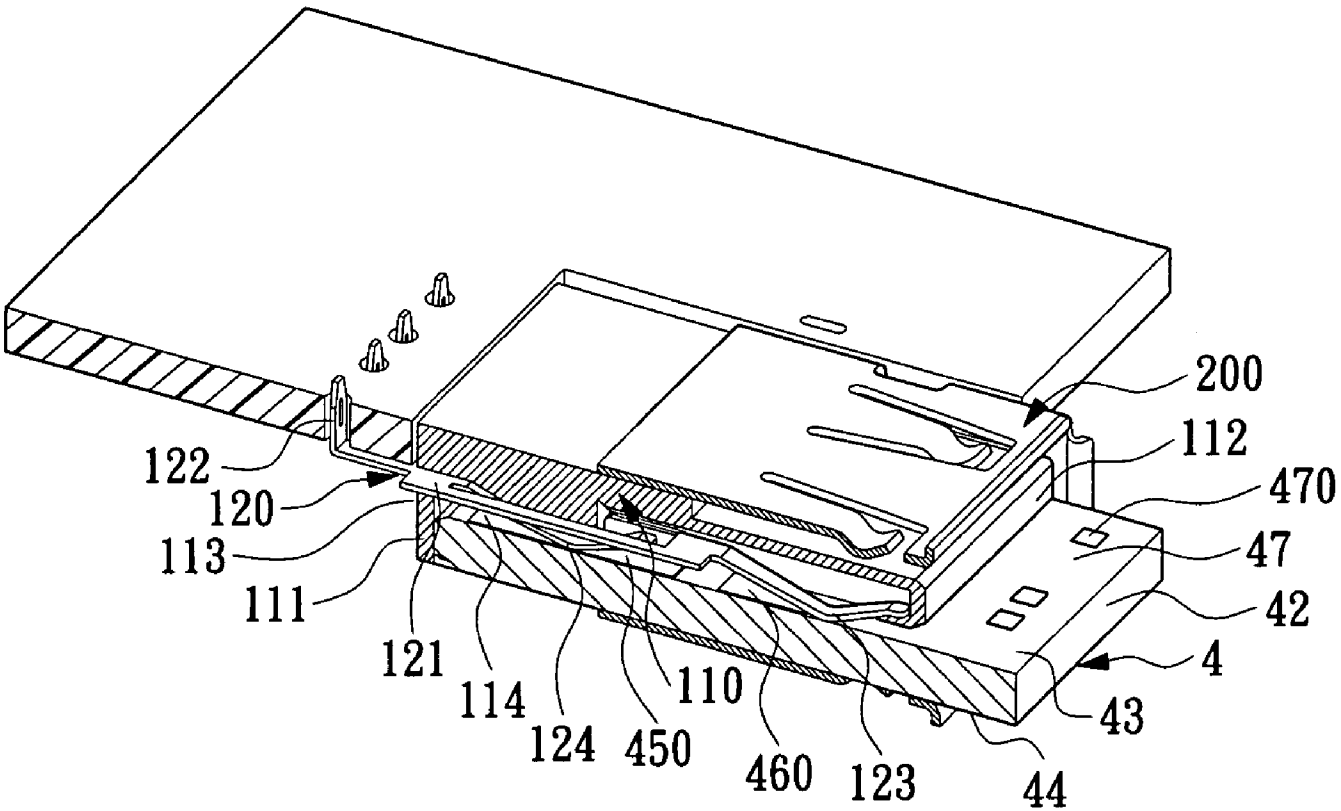
FIG. 4 is an assembled perspective view of an improved electrical connector connected with a plug assembly.
Figure 10:
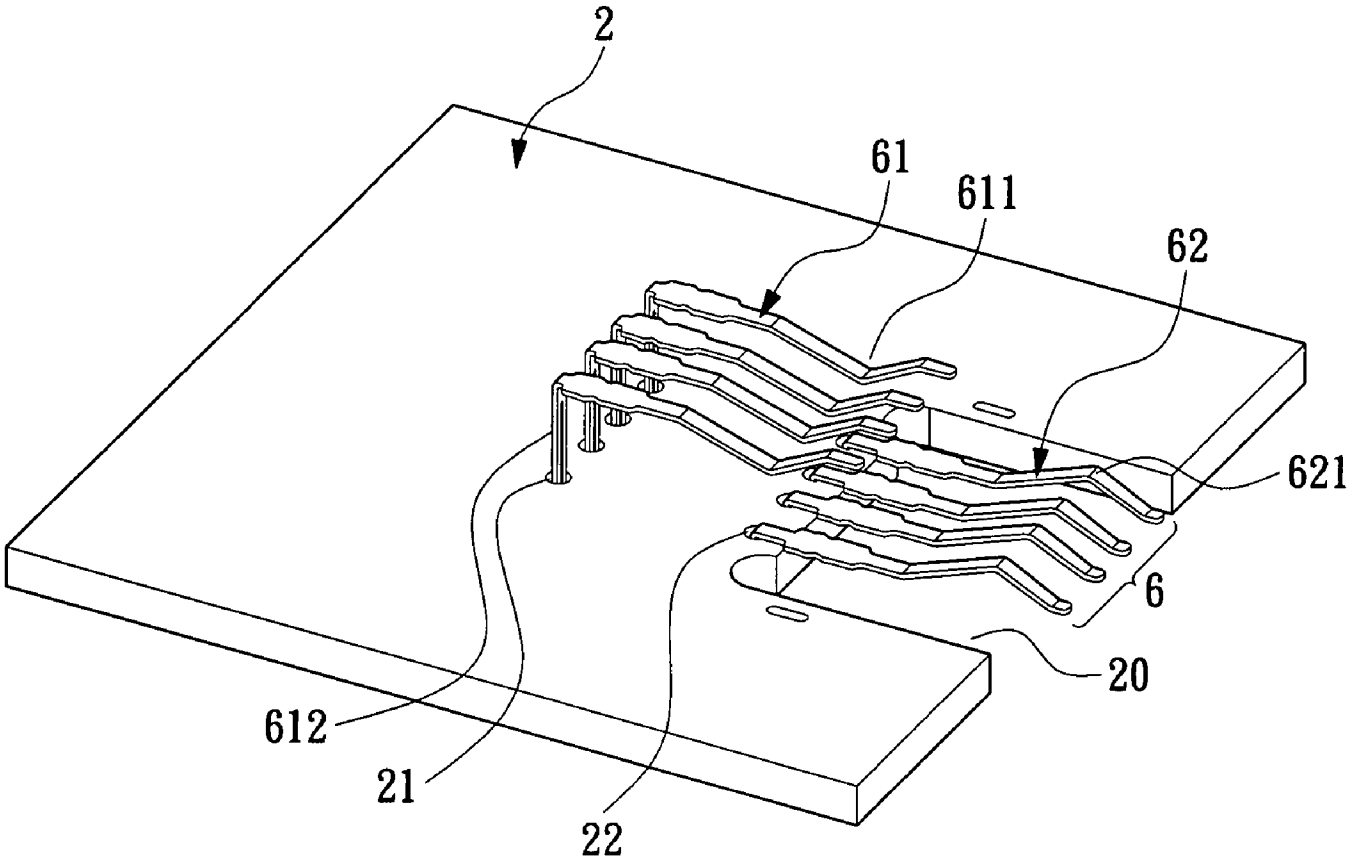
FIG. 10 is a perspective view showing that conductive terminals of the electrical connector in FIG. 5 are assembled on a circuit board.
Figure 11:
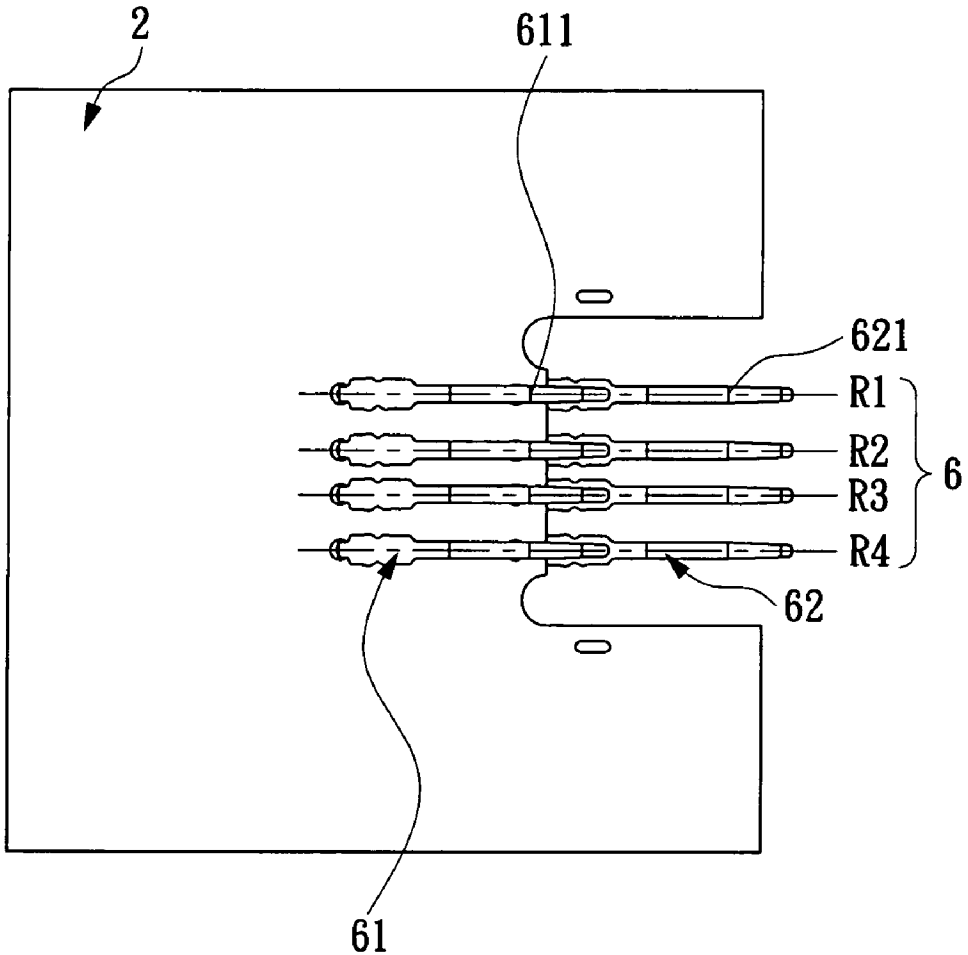
FIG. 11 is a top view showing that the conductive terminals of the electrical connector in FIG. 5 are assembled on the circuit board.

Please refer to FIG. 7, FIG. 10 and FIG. 11, the conductive terminals 6 include a plurality of first conductive terminals 61 and a plurality of second conductive terminals 62, wherein the plurality of first conductive terminals 61 form a first conductive terminal group and the plurality of second conductive terminals 62 form a second conductive terminal group. The first conductive terminals 61 are correspondingly disposed in the first terminal passages 521. Each first conductive terminal 61 has a first contacting portion 611 extending forwards and a first connecting portion 612 which is formed by extending the first conductive terminal 61 rearwards through the rear end of the main body portion 51 and then bending the first conductive terminal 61 downward, wherein the first connecting portion 612 and the first contacting portion 611 are connected with and perpendicular to each other. The second conductive terminals 62 have the similar structure to that of the first conductive terminals 61. The second conductive terminals 62 are correspondingly disposed in the second terminal passages 542. Each second conductive terminal 62 has a second contacting portion 621 extending forwards and a second connecting portion 622 which is formed by bending and extending the second conductive terminal 62 downward (that is, towards the circuit board 2) when the second conductive terminal 62 is extended to the cutout 551, wherein the second connecting portion 622 and the second contacting portion 621 are connected with and perpendicular to each other. That is, the second connecting portion 622 extends downward vertically in the cutout 551. In the embodiment, when extending to the cutout 551, each second conductive terminal 62 is bent and extends downward. Each second conductive terminal 62 doesn't like each first conductive terminal 61 which is bent and extends downward after extending rearwards through the rear end of the main body portion 51. So the whole length of each second conductive terminal 62 is reduced, so that manufacturing materials are saved, production cost is reduced, and signal transmission distance effectively decreases and the resistance is reduced, which is favorable to high-frequency transmission. Furthermore, in a top-view direction, each first conductive terminal 61 and the corresponding second conductive terminal 62 lie on a direct line (such as center lines R1, R2, R3, R4 of the terminals which are parallel to each other, as shown in FIG. 11). The first contacting portion 611 of each first conductive terminal 61 and the second contacting portion 621 of the corresponding second conductive terminal 62 overlap, that is, the front end of the first contacting portion 611 of each first conductive terminal 61 is located above the rear end of the second contacting portion 621 of the corresponding second conductive terminal 62. The structure features and arrangement of the conductive terminals 6 can not only ensure that the electrical connector 1 is effectively connected with the conventional socket assembly (for example, standard USB socket connector) 3, but also achieve the correct electrical connection of the electrical connector 1 and the memory card 4 (pleaser refer to FIG. 3, when an interface of the memory card 4, for example, the first interface, is a USB interface, that is, the memory card 4 has the first contacting points 450 as shown in FIG. 3, the electrical connection of the memory card 4 and the standard USB plug connector can be achieved), so the first contacting points 450 of the memory card 4 needn't to be arranged extra. Of course, in other embodiments, the conductive terminals 6 can have other structure features and can be arranged in other ways depending on demands to be suitable for the arrangement of the contacting points on the memory card 4 and the socket assembly 3 which can engage with the electrical connector 1, which is omitted herein.

Pleaser refer to FIG. 7, the circuit board 2 has a joint opening 20, a plurality of spaced first pin holes 21 into which the first connecting portions 612 of the first conductive terminals 61 are inserted correspondingly, a plurality of spaced second pin holes 22 into which the second connecting portions 622 of the second conductive terminals 62 are inserted correspondingly, and two welding points (not shown) which are respectively welded on the welding piece 75 of the shielding casing 7.

Please refer to FIG. 7, in assembly, firstly, the first conductive terminals 61 and the second conductive terminals 62 are respectively correspondingly received in the first terminal passages 521 and the second terminal passages 542, and then the shielding casing 7 abuts against the front end of the main body portion 51 and surrounds the tongue plate 54 and the second receiving space 53, thereby a complete electrical connector 1 is assembled. Please refer to FIG. 6 simultaneously, when the electrical connector 1 is assembled on the circuit board 2, the first connecting portions 612 of the first conductive terminals 61 and the second connecting portions 622 of the second conductive terminals 62 are respectively and correspondingly inserted and welded in the first pin holes 21 and the second pin holes 22 in the circuit board 2, the welding pieces 75 of the shielding casing 7 are correspondingly welded on the welding points of the circuit board 2. At this time, the mounting portion 55 of the electrical connector 1 just abuts against the circuit board 2, and the front portion of the main body portion 51 of the insulating body 5 and the shielding casing 7 of the electrical connector 1 pass through the joint opening 20 of the circuit board 2, so that the electrical connector 1 is locked in the joint opening 20.

Please refer to FIG. 6 and FIG. 7, during inserting of the memory card 4, firstly, correspondingly dispose the memory card 4 in front of the electrical connector 1, wherein the first insulating surface 43 faces up and the opposite second insulating surface 44 faces down, that is, the first insulating surface (front face) 43 faces to the top plate 71 of shielding casing 7 and the second insulating surface (back face) 44 faces to the tongue plate 54. Then, push the memory card 4 so that the memory card 4 enters the first receiving space 52 from the second receiving space 53 above the tongue plate 54 of the electrical connector 1, that is, the memory card 4 passes through the second receiving space 53 and the first receiving space 52 in turn, and the first contacting points 450 of the first interface 45 of the first insulating surface 43 of the memory card 4 are just respectively correspondingly electrically connected with the first contacting portions 611 of the conductive terminals 61, and the second insulating surface 44 is adjacent to the bottom surface of the first receiving space 52 and contacts with the second conductive terminals 62. Accordingly, the memory card 4 is only electrically connected the first contacting portions 611 of the first conductive terminals 61 correspondingly, so there is no other in-series disturbed signal noise for stable signal transmission. Additionally, the memory card 4 is inserted in the longer inserting space which is formed by the second receiving space 53 and the first receiving space 52 together, so the protruding portion of the memory card 4 which extends out of the electrical connector 1 is short, thereby the memory card 4 cannot swing and can be connected stably.

Consequently, the electrical connector 1 of the present invention has the advantages as follows:

1. In the present invention, the two protruding blocks 522 are respectively disposed on the two sides of the first receiving space 52 near the bottom surface of the first receiving space 52, respectively. One step surface is formed between each protruding block 522 and the bottom surface of the first receiving space 52. The second insulating surface 44 of the memory card 4 has two concave portions 440 respectively concavely formed in the two side edges thereof. The protruding blocks 522 and the concave portions 440 engage with each other to prevent the memory card 4 from being inserted by mistake. That is, when the memory card 4 is inserted correctly, the protruding blocks 522 are just locked in the concave portions 440 of the memory card 4 and perform a guiding function; and when the memory card 4 is inserted by mistake, the protruding blocks 522 block the memory card 4 and prevent the memory card 4 from entering the first receiving space 52.

2. In the present invention, when extending to the cutout 551, each second conductive terminal 62 is bent and extends downward. Each second conductive terminal 62 doesn't like each first conductive terminal 61 which is bent and extends downward after extending rearwards through the rear end of the main body portion 51. So the whole length of each second conductive terminal 62 is reduced, so that manufacturing materials are saved, production cost is reduced, and signal transmission distance effectively decreases and the resistance is reduced, which is favorable to high-frequency transmission.

3. In the present invention, in a top-view direction, each first conductive terminal 61 and the corresponding second conductive terminal 62 lie on a direct line (such as center lines R1, R2, R3, R4 of the terminals which are parallel to each other, as shown in FIG. 11). The first contacting portion 611 of each first conductive terminal 61 and the second contacting portion 621 of the corresponding second conductive terminal 62 overlap, that is, the front end of the first contacting portion 611 of each first conductive terminal 61 is located above the rear end of the second contacting portion 621 of the corresponding second conductive terminal 62. The structure features and arrangement of the conductive terminals 6 can not only ensure that the electrical connector 1 is effectively connected with the conventional socket assembly (for example, standard USB socket connector) 3, but also achieve the correct electrical connection of the electrical connector 1 and the memory card 4 (pleaser refer to FIG. 3, when an interface of the memory card 4, for example, the first interface, is a USB interface, that is, the memory card 4 has the first contacting points 450 as shown in FIG. 3, the electrical connection of the memory card 4 and the standard USB plug connector can be achieved, so the first contacting points 450 of the memory card 4 don't need to be arranged extra.

4. In the present invention, during inserting of the memory card 4, firstly, correspondingly dispose the memory card 4 in front of the electrical connector 1 and the first insulating surface 43 faces up and the opposite second insulating surface 44 faces down, that is, the first insulating surface (front face) 43 faces to the top plate 71 of the shielding casing 7 and the second insulating surface (back face) 44 faces to the tongue plate 54. Then, push the memory card 4 so that the memory card 4 enters the first receiving space 52 from the second receiving space 53 above the tongue plate 54 of the electrical connector 1, that is, the memory card 4 passes through the second receiving space 53 and the first receiving space 52 in turn, and the first contacting points 450 of the first interface 45 of the first insulating surface 43 of the memory card 4 are just respectively correspondingly electrically connected with the first contacting portions 611 of the conductive terminals 61, and the second insulating surface 44 is adjacent to the bottom surface of the first receiving space 52 and contacts with the second conductive terminals 62. Accordingly, the memory card 4 is only electrically connected with the first contacting portions 611 of the first conductive terminals 61 correspondingly, so there is no other in-series disturbed signal noise for stable signal transmission.

5. In the present invention, the memory card 4 is inserted in the longer inserting space which is formed by the second receiving space 53 and the first receiving space 52 together, so the protruding portion of the memory card 4, which extends out of the electrical connector 1, is short, thereby the memory card 4 cannot swing and can be connected stably.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. An electrical connector, comprising:

an insulating body, having a main body portion, wherein a first receiving space is concavely formed in the main body portion and extends from a front end of the main body to a rear end of the main body and the main body portion has a plurality of spaced first terminal passages extending in a top surface of the first receiving space; a second receiving space is formed in the front end of the main body portion and connected with the first receiving space; and a tongue plate extends forwards from a front end face of the main body portion, the second receiving space is located above the tongue plate, and the tongue plate has a working surface on which a plurality of spaced second terminal passages extends;

a plurality of first conductive terminals, respectively correspondingly received in the first terminal passages; and a plurality of second conductive terminals, respectively correspondingly received in the second terminal passages.

2. The electrical connector as claimed in claim 1, further comprising a shielding casing outside the insulating body, the shielding casing surrounding the tongue plate and the second receiving space and having a top plate, wherein the second receiving space is defined by the top plate and the tongue plate.

3. The electrical connector as claimed in claim 1, wherein the working surface of the tongue plate is located on a surface of the tongue plate which is adjacent to the second receiving space.

4. The electrical connector as claimed in claim 1, wherein the working surface of the tongue plate is located on a surface of the tongue plate which is far away from the second receiving space.

5. The electrical connector as claimed in claim 1, wherein at least one side of the first receiving space has a fool-proof unit formed thereon.

6. The electrical connector as claimed in claim 1, wherein each of the first terminal passages is disposed corresponding to one of the second terminal passages.

7. An electrical connector, comprising:

a socket connector having a main body portion, an inserting space concavely formed in the main body portion and extending from a front end of the main body to a rear end of the main body, and the main body portion having a plurality of spaced first conductive terminals extending on a top surface of the inserting space; and a plug connector extending from the socket connector, the plug connector having a tongue plate extending forwards from a front end of a bottom of the main body portion of the socket connector, a plurality of spaced second conductive terminals extending on a surface of the tongue plate; wherein when an plug assembly is connected, the plug assembly goes over the tongue plate of the plug connector and is just inserted in the inserting space of the socket connector; and when a socket assembly is connected, the socket assembly just covers the tongue plate of the plug connector and is blocked outside the socket connector.

8. The electrical connector as claimed in claim 7, wherein the plug connector further includes a shielding casing surrounding the tongue plate.

9. The electrical connector as claimed in claim 8, wherein the shielding casing of the plug connector and the tongue plate define a butting space together, which is connected with the inserting space of the socket connector.

10. The electrical connector as claimed in claim 7, wherein the main body portion has a fool-proof unit formed on at least one side of the inserting space.

11. The electrical connector as claimed in claim 7, wherein the main body portion has a plurality of spaced first terminal passages formed in a top surface of the inserting space, and the plurality of first conductive terminals are respectively correspondingly received in the first terminal passages.

12. The electrical connector as claimed in claim 11, wherein a plurality of spaced second terminal passages is formed in an upper surface of the tongue plate, and each of the first terminal passages is disposed corresponding to each second terminal passage.

13. The electrical connector as claimed in claim 7, wherein a plurality of spaced second terminal passages is formed in an upper surface of the tongue plate, and the plurality of second conductive terminals are respectively correspondingly received in the second terminal passages.

14. An electrical connector, comprising:

a main body portion, having a receiving space concavely formed in a front end thereof, a protrusion extending forwards from the front end thereof and a cutout concavely formed in a bottom thereof, wherein the protrusion has a guiding surface formed on a top thereof and connected with a bottom surface of the receiving space, and the cutout is connected with the receiving space;

a plurality of spaced first conductive terminals disposed on a top surface of the receiving space and each having a first connecting portion which is formed by extending each first conductive terminal rearwards through a rear end of the main body portion and then bending the first conductive terminal downwards; and a plurality of spaced second conductive terminals disposed on the guiding surface of the protrusion and each having a second connecting portion which is formed by bending and extending the second conductive terminal downward when the second conductive terminal is extended to the cutout.

15. The electrical connector as claimed in claim 14, wherein the second connecting portion extends downwards vertically in the cutout.

16. The electrical connector as claimed in claim 14, wherein the main body portion has a mounting surface formed adjacent to the cutout.

17. The electrical connector as claimed in claim 14, wherein the main body portion has a fool-proof unit formed on at least one side of the receiving space.

18. The electrical connector as claimed in claim 14, wherein the main body portion has a plurality of spaced first terminal passages formed in a top surface of the receiving space, and the plurality of first conductive terminals are respectively correspondingly received in the first terminal passages.

19. The electrical connector as claimed in claim 18, wherein a plurality of spaced second terminal passages is formed in the guiding surface of the protrusion, and each of the first terminal passages is disposed corresponding to each second terminal passage.

20. The electrical connector as claimed in claim 14, wherein a plurality of spaced second terminal passages is formed in the guiding surface of the protrusion, and the plurality of second conductive terminals are respectively correspondingly received in the second terminal passages.

21. The electrical connector as claimed in claim 14, further comprising a shielding casing surrounding the protrusion to form a butting portion.

22. A method of inserting an electrical connector comprising the steps of:

(1). providing an electrical connector which includes:

a main body portion, having a receiving space which is concavely formed in the main body portion and extends from a front end face of the main body to a rear end face of the main body, and a tongue plate extending forwards from a front end of a bottom of the main body portion;

a plurality of spaced first conductive terminals disposed on a top surface of the receiving space; and a plurality of spaced second conductive terminals disposed on an upper surface of the tongue plate;

(2). providing a memory card which has a first insulating surface and a second insulating surface opposite to the first insulating surface, the first insulating surface having a plurality of spaced contacting points;

(3). disposing the memory card in front of the electrical connector correspondingly, the first insulating surface facing up and the opposite second insulating surface facing down; and (4). pushing the memory card so that the memory card goes over the tongue plate of the electrical connector and enters the receiving space, each of the contacting points of the first insulating surface is just correspondingly electrically connected with one of the first conductive terminals, and the second insulating surface contacts with the second conductive terminals.

23. The method of inserting an electrical connector as claimed in claim 22, wherein the main body portion has a plurality of spaced first terminal passages extending in a top surface of the receiving space, and the plurality of first conductive terminals are respectively correspondingly received in the first terminal passages.

24. The method of inserting an electrical connector as claimed in claim 23, wherein a plurality of spaced second terminal passages extends in an upper surface of the tongue plate, and each of the first terminal passages is disposed corresponding to each second terminal passage.

25. The method of inserting an electrical connector as claimed in claim 22, wherein a plurality of spaced second terminal passages extends in an upper surface of the tongue plate, and the plurality of second conductive terminals are respectively correspondingly received in the second terminal passages.

26. The method of inserting an electrical connector as claimed in claim 22, further comprising disposing a shielding casing which surrounds the tongue plate so that a containing space is formed above the tongue plate and connected with the receiving space backward.

* * * * *